United States Patent [19]

Ostrem et al.

[11] 4,040,540

[45] Aug. 9, 1977

[54] EDGE PROTECTION FOR EASY OPENING END CLOSURE

[75] Inventors: Obert M. Ostrem, Westmont; Donald F. Kulikowski, Oak Forest; Sam C. Pulciani, Norridge, all of Ill.

[73] Assignee: The Continental Group, Inc., New York, N.Y.

[21] Appl. No.: 712,440

[22] Filed: Aug. 9, 1976

Related U.S. Application Data

[63] Continuation of Ser. No. 641,472, Dec. 17, 1975, abandoned.

[51] Int. Cl.[2] ..... B65D 41/32

[52] U.S. Cl. ..... 220/273; 220/90.6

[58] Field of Search ..... 220/90.6, 270–273, 220/269; 113/121 C, 15 A

[56] References Cited

U.S. PATENT DOCUMENTS

| | | | |
|---|---|---|---|
| 3,825,149 | 7/1974 | Brown et al. | 220/270 |
| 3,986,632 | 10/1976 | Morrison et al. | 220/273 |

*Primary Examiner*—George T. Hall

*Attorney, Agent, or Firm*—John J. Kowalik; Joseph E. Kerwin; William A. Dittmann

[57] ABSTRACT

An easy opening end closure is formed with annular, double folded band adjacent the chuck wall. A weakening line defining a removable panel portion is formed in the center segment of the fold so that the folded edges of the single band provide smooth protective surfaces on both the ledge and the removable panel portion.

This disclosure also relates to a method for forming the above described easy-opening end closure wherein the weakening line is formed in the end panel prior to complete formation of the folded band.

15 Claims, 8 Drawing Figures

EDGE PROTECTION FOR EASY OPENING END CLOSURE

This is a continuation, of Ser. No. 641,472, filed Dec. 17, 1975.

BACKGROUND OF THE INVENTION

The present invention relates to new and improved easy opening end closure of the full panel opening type and more particularly to the method of forming the same.

Full opening containers of the type to which the present invention relates include an end closure of which the end panel is formed with a weakening line located closely adjacent the chuck wall. The weakening line is formed by scoring and defines a removable panel section to which there is attached a pull tab. The pull tab is mounted so that upon initial lifting thereof the nose of the tab penetrates the weakening line to initiate the severance of the removable panel section from the end panel. Thereafter, the pull tab is pulled upwardly so that the remainder of the weakening line is ruptured and the removable panel section separated from the remainder of the panel substantially in the form of a disc.

The opening thus formed in the end closure is bounded by a horizontal ledge which terminates in a sharp raw edge caused by the severance of the removable panel portion therefrom. This sharp edge presents a hazard.

The edge on the removable portion is also sharp.

Folded end panels for edge protection are known in the art as, for example, Holk, U.S. Pat. No. 3,848,557. However, in the prior art, a fold band protects a single edge only and two bands are required to protect the edges of both the ledge and the removable panel. The requirement of two fold bands complicates the production process and increases the probability of rejection of the closure due to accidental fracture of the score line during fabrication.

SUMMARY OF THE INVENTION

By the present invention, it is proposed to provide a full opening easy-open end closure constructed and arranged so that the raw edges about the horizontal ledge and the removable panel are protected after severance of the removable panel portion. It is thus seen that the folded band comprises a first closed fold portion on the ledge having a folded edge facing inwardly, and a second closed fold portion on the panel having a folded edge facing outwardly, the folded edge on the panel being radially outward of the folded edge on the ledge.

This is accomplished generally by an end closure having an annular, double folded-band formed in the end panel adjacent the end closure chuck wall and in which a weakening line is formed in the center segment of the fold, so that the folded edges of the band provide smooth surfaces which bound the opening and the removable flap after separation.

It is another object to provide a new and novel method for forming a full opening easy-open end closure constructed in the manner specified in the foregoing object.

This is accomplished by forming the annular folded band in stages and the weakening line is formed by scoring prior to the final fold steps.

With the above and other objects in view that will hereinafter appear, the nature of the invention will be more readily understood by reference to the following description, the appended claims and the several views illustrated in the accompanying drawings.

DESCRIPTION OF THE PREFERRED EMBODIMENT

In accordance with the present invention, there is provided an easy-open end closure comprising an end panel 1 and a pull tab 2.

Figure 5:
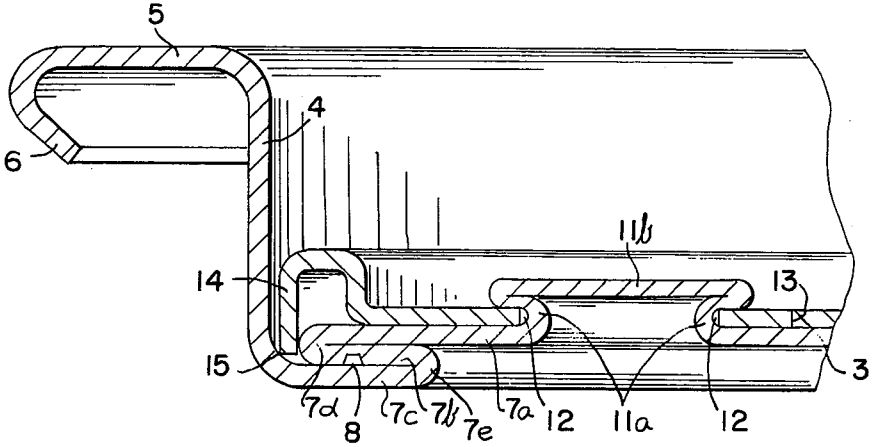
FIG. 5 is a fragmentary cross-sectional view taken substantially along line 4—4 of FIG. 1.
Figure 6:
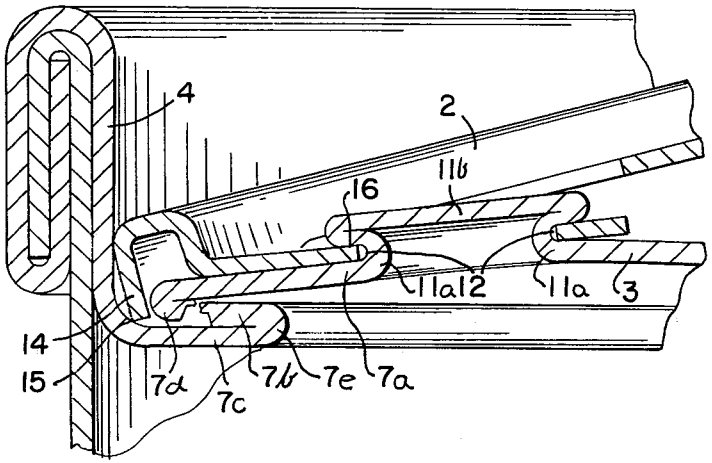
FIG. 6 is a fragmentary cross-sectional view similar to FIG. 5, illustrating the tab being lifted to open the closure.

The end panel 1 includes a substantially horizontally extending central panel 3 having at its periphery a chuck wall 4 which terminates in a horizontal flange 5 and a curled end 6. The central panel 3 is formed with an annular, double-folded band 7, radially inward of the chuck wall 4. As best seen in FIG. 5, the band 7 comprises substantially planar upper, intermediate and lower segments *7a, 7b* and *7c* respectively and curved segments *7d* and *7e,* the curved segments *7d* and *7e* connecting the planar segments *7a, 7b* and *7c* in an S-shaped series with the planar segments being substantially parallel and in close contact. A score line 8 is formed in the intermediate segment *7b,* in the side thereof toward the lower segment *7c,* and encircles an opening flap 9. The portion of the central panel 3 radially outward of the score line 8 is commonly referred to as the ledge, while the portion radially inward thereof is known as the removable panel portion or closure portion.

The pull tab 2 is longitudinally rigid and comprises a nose portion, an intermediate portion and a lift portion *2a, 2b* and *2c* respectively. The tab 2 is attached to the end panel 1 by a rivet 11, integrally formed in the central panel 3 in the portion thereof radially inward of the score 8. The rivet shank 11*a* passes through an opening 12 in the intermediate portion *2b* with the rivet head 11*b* pressing against the upper surface of the tab 2. A horseshoe shaped slit 13 is formed in the intermediate portion *2b* encompassing the rivet 11 and opening toward the nose portion *2a.* The nose portion *2a* terminates in a substantially vertical end member 14 which engages the central panel 3 at a point 15 between the chuck wall 4 and the fold band 7.

To open the closure, the lift portion of the tab 2 is displaced vertically, causing the tab 2 to pivot about the point of contact 15 between the end member 14 and the central panel 3 and impressing a downward force on the lower segment 7*c* and intermediate segment 7*b* of the fold band 7. At the same time, the intermediate portion 2*b* of the tab 2 is exerting an upward force on the rivet head 11*b* at the point 16 thereon nearest the end member 14. This upward force is communicated to the upper segment 7*a* of the fold 7 through the rivet shank 11*a*. The opposing forces thus placed on the intermediate segment 7*b* result in fracture of the score line 8 in the area immediately adjacent the end member 14. After fracture has been initiated, the tab 2 is pulled away from the end panel 1 in the conventional manner to effect controlled tearing of the remainder of the score 8 and removal of the flap 9.

Figure 8:
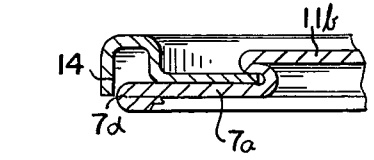
FIG. 8 is a fragmentary cross-sectional view illustrating the portion of the end closure removed from the container during opening.
Figure 7:
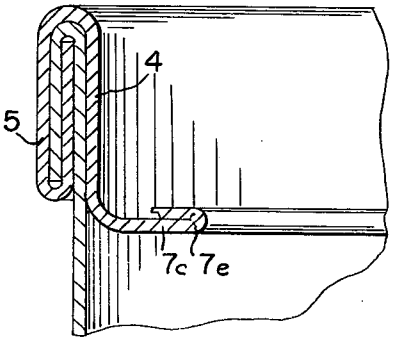
FIG. 7 is a fragmentary cross-sectional view illustrating the portion of the end closure attached to the container after opening.

As may be seen in FIGS. 7 and 8, the sharp edges created by the tearing of the score 8 are in shielded positions abutting the upper and lower segments 7*a* and 7*b* of the fold band 7. The flap 9 and the periphery of the opening in the central panel 3 present the harmless turned smooth surfaces of the curved segments, 7*d* and 7*e* respectively, to the user and others coming into contact with the closure.

Figure 1:
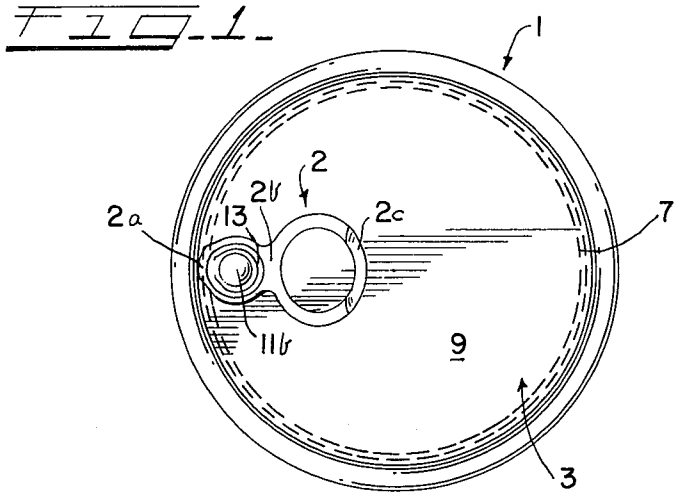
FIG. 1 is a top plan view of a full opening easy-open end closure incorporating the easy opening structure of the present invention.
Figure 2:
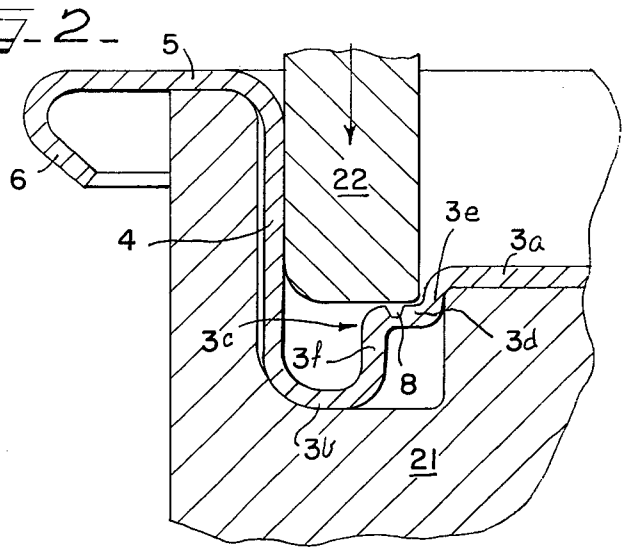
FIG. 2 is a fragmentary cross-sectional view of an end panel illustrating a step in the formation of the end closure of FIG. 1.

Referring to FIGS. 2, 3, 4 and 5 illustrating the stations for forming the end closure of the present invention, in FIG. 2 there is illustrated a first station for forming the same. In this station, the end panel 1 has already been formed with a chuck wall 4, flange 5 and curl 6 by means well known in the art. In addition, the center of the central panel 3 has been upset to form a section 3*a* axially spaced from the remaining section 3*b* of the panel 3, the two sections 3*a* and 3*b* being joined by a connecting portion 3*c* having formed therein a score line 8. Although it is preferred that the connecting portion 3*c* be formed as a substantially horizontal ledge 3*d* and two substantially vertical members 3*e* and 3*f*, and that the score line 8 be located on the upper surface of the ledge 3*d*, it is to be understood that other connecting portion configurations and score locations therein are contemplated in the present invention. The end panel 1 rests on an anvil 21 which provides support for the flange 5 and chuck wall 4 and both sections 3*a* and 3*b* of the central panel 3. A punch 22 is provided which is configured to fit between the chuck wall 4 and the uppermost vertical member 3*f* of the connecting portion 3*c*.

Figure 3:
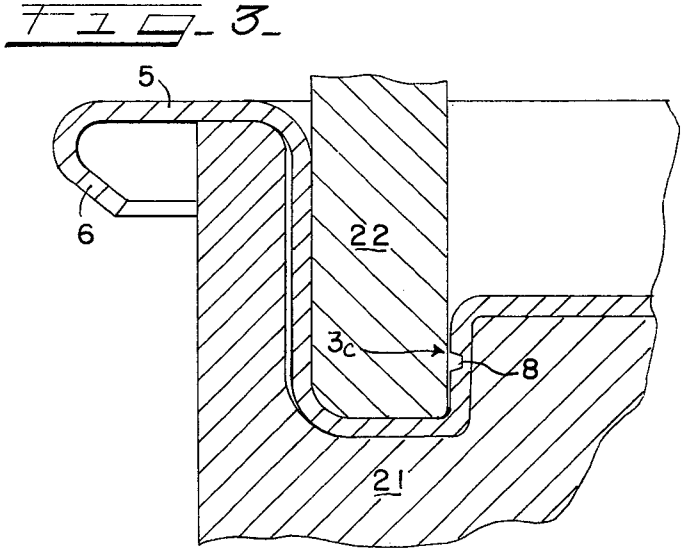
FIG. 3 is a fragmentary cross-sectional view similar to FIG. 2, illustrating another formation step.

In FIG. 3, the punch 22 has been displaced vertically toward the anvil 21, thereby upsetting the connecting portion 3*c* such that the ledge 3*d* assumes a substantially vertical position. It is to be noted that the score line 8 is displaced radially inwardly during this operation. This reduction in the length of the score 8 results in the forces impressed thereon during the reformation being primarily compressive rather than tensile. This avoidance of tensile loading prevents score fracture during the forming process.

Figure 4:
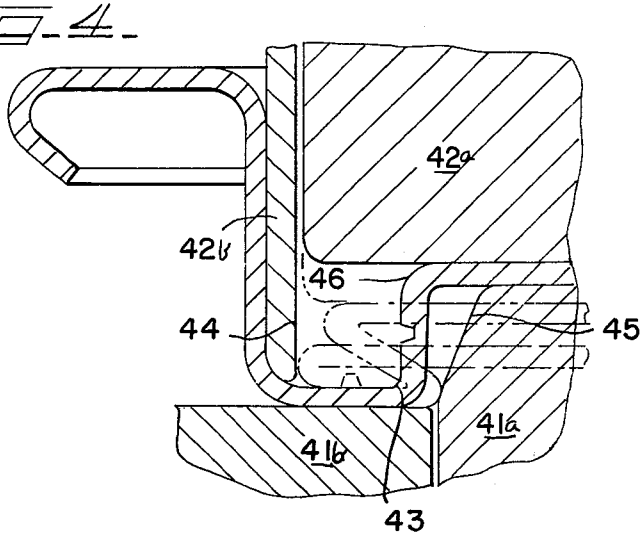
FIG. 4 is a fragmentary cross-sectional view similar to FIGS. 2 and 3, illustrating yet another formation step.

In the second forming station, illustrated in FIG. 4, there is provided a split anvil 41 and a split punch 42, each comprising a central movable portion 41*a* and 42*a* respectively and an outer fixed portion 41*b* and 42*b* respectively. The partially formed end closure from the first forming station is clampingly held between the fixed portions 41*b* and 42*b* of the punch 42 and the anvil 41. The movable portion 42*a* of the punch 42 is then displaced downwardly, causing a corresponding downward movement of the movable portion 41*a* of the anvil 41. As the punch portion 42*a* descends, the connecting portion 3*c* collapses, rotating outwardly and downwardly about a point 43 at the juncture of the connecting portion 3*c* and the lower portion 3*b* of the central panel 3. The collapsing connecting section 3*c* is constrained to move between the opposing faces 44 and 45 of the fixed portion of the punch 42*b* and the movable portion of the anvil 41*a*. As the punch 42 descends, the upper end 46 of the connecting portion 3*c* encounters the punch face 44. As the punch continues downward, the lower end 43 of the connecting portion 3*c* is forced against the moving face 45 of the anvil 41. It is to be noted that the punch face 44 is substantially vertical while the anvil face 45 slopes upwardly and inwardly. Thus, the score line 8 is again displaced radially inwardly while being subjected to a primarily compressing loading. After the connecting portion 3*c* has been folded flat against the lower central panel portion 3*b*, the pull tab 2 is attached to the upper panel portion 3*a* with an integrally formed rivet 9 according to methods well known in the art.

We claim:

1. An easy opening container end closure having a ledge portion and a removable panel portion, a single band folded under said panel portion and over said ledge portion, and a score located in said band intermediate the folds of the band presenting smooth turned surfaces on the ledge and the removable panel portion after said score is fractured and the panel portion removed.

2. An easy opening container end closure comprising a ledge portion, a closure portion, an intervening band connected to the peripheral edges of both of said portions by folds, and a score line positioned in said band, whereby turned smooth surfaces are presented along the edges of the closure portion and the ledge subsequent to fracture of said score line.

3. An easy opening container end closure comprising an end panel having a double folded band and a score line defining an opening flap, said score line being located in said band substantially equidistantly spaced from the folds of said double fold, whereby turned smooth surfaces are presented along the periphery of the flap and the opening in the end panel subsequent to fracture of said score line.

4. The invention of claim 3 and a pull tab attached to said opening flap for fracturing said score line to open said container.

5. The invention of claim 4, wherein said folded band is annular.

6. An easy opening end closure comprising an end panel having a folded band, and a score line defining an opening flap, said folded band comprising upper, intermediate and lower planar segments connected in S-shaped series by curved segments, said score line being located in said intermediate segment, whereby the edges of said end panel and said opening flap are bounded by said curved segments subsequent to fracture of said score line.

7. The invention of claim 6 and means for relatively displacing said upper and lower segments to effect fracture of said score line to open said end closure.

8. The invention of claim 7, wherein said displacing means comprises a pull tab attached to said opening flap.

9. The invention of claim 8, wherein said pull tab comprises a nose portion, an intermediate portion and a lift portion, said pull tab being attached to said opening flap by means of a rivet passing through said intermediate portion, and a horse-shoe shaped slit formed in said intermediate portion encompassing said rivet, and opening toward said nose portion.

10. The invention of claim 2, wherein said intervening band is completely overlapped, on both sides thereof, by said ledge portion and said closure portion.

11. The invention of claim 3, wherein said score line is covered, on both sides of said band, by planar portions of said double-folded band.

12. The invention of claim 6, wherein each of said upper and lower segments is at least as wide as said intermediate segment.

13. The invention of claim 1, wherein said ledge portion and said panel portion are substantially planar, and said panel portion overlaps said ledge portion, whereby said panel portion may be unobstructedly removed from the remainder of said closure subsequent to fracture of said score line.

14. The invention of claim 2 wherein said ledge portion and said closure portion are substantially planar and said closure portion overlaps said ledge portion, whereby said closure portion may be unobstructedly removed from the remainder of said closure subsequent to fracture of said score line.

15. An easy opening container end closure comprising an end panel having an opening score line, said score line dividing said end panel into a ledge portion and a closure portion, said ledge portion including a first closed fold portion having a folded edge facing inwardly, said closure portion having a second closed fold portion having a folded edge facing outwardly, said folded edge on said closure portion being radially outward of said folded edge on said ledge, said folded edges being serially connected by a substantially planar intermediate portion, said score line being formed in said intermediate portion, whereby smooth turned surfaces are presented on said ledge portion and said closure portion after said score is fractured and said closure portion is removed.

* * * * *